US008276602B2

(12) United States Patent
Kim

(10) Patent No.: US 8,276,602 B2
(45) Date of Patent: Oct. 2, 2012

(54) GARBAGE COLLECTING APPARATUS OF DISHWASHER

(75) Inventor: Kyung-Rae Kim, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 817 days.

(21) Appl. No.: 12/230,625

(22) Filed: Sep. 2, 2008

(65) Prior Publication Data

US 2009/0065033 A1 Mar. 12, 2009

(30) Foreign Application Priority Data

Sep. 4, 2007 (KR) ..... 10-2007-0089683

(51) Int. Cl.
*B08B 3/14* (2006.01)
*B01D 29/50* (2006.01)

(52) U.S. Cl. ..... 134/111; 134/104.2; 134/56 D; 134/58 D; 134/104.4; 210/495; 210/498

(58) Field of Classification Search ..... 210/498, 210/499, 495
See application file for complete search history.

(56) References Cited

U.S. PATENT DOCUMENTS 3,708,848 A * 1/1973 Guinard ..... 29/896.62
4,998,548 A 3/1991 Lagerstrand
5,129,411 A * 7/1992 Lagerstrand ..... 134/56 D
2004/0050774 A1 3/2004 Jerg

FOREIGN PATENT DOCUMENTS

| | | | |
|---|---|---|---|
| DE | 68910298 | T2 | 5/1994 |
| DE | 10065660 | A1 | 7/2002 |
| FR | 2 113 854 | | 6/1972 |
| FR | 2 714 282 | A1 | 6/1995 |
| GB | 2 284 980 | A | 6/1995 |
| JP | 50-58557 | | 5/1975 |
| JP | 2002-209825 | A | 7/2002 |

* cited by examiner

*Primary Examiner* — Michael Barr
*Assistant Examiner* — Caitlin N Dunlap
(74) *Attorney, Agent, or Firm* — Birch, Stewart, Kolasch & Birch, LLP

(57) ABSTRACT

A garbage collecting apparatus of a dishwasher, mounted in a dishwasher such that washing water is pumped by a washing pump to wash garbage on targets to be washed, and then such used washing water is drained by a drain pump, the apparatus including a first garbage collecting net, and a second garbage collecting net having a mesh size relatively greater than that of the first garbage collecting net, whereby various sizes of garbage can be filtered by the garbage collecting apparatus, so as to automatically be discharged to the exterior, and also a decomposition, a displeasure, an inconvenience due to washing of the collecting nets and the like which may be caused when such garbage remains in the garbage collecting apparatus can be solved.

11 Claims, 7 Drawing Sheets

GARBAGE COLLECTING APPARATUS OF DISHWASHER

RELATED APPLICATION

The present disclosure relates to subject matter contained in priority Korean Application No. 10-2007-0089683, filed on Sep. 4, 2007, which is herein expressly incorporated by reference in its entirety.

BACKGROUND OF THE INVENTION

1. Field of the Invention

The present invention relates to a dishwasher, and particularly, to a garbage collecting apparatus of a dishwasher.

2. Background of the Invention

A dishwasher is a machine for washing garbage remaining on a dishware (e.g., dishes, cups, bowls and the like) by injecting a high pressure of washing water onto the dishes contained in a wash tub or washing chamber. Such dishwasher is configured such that dishes are washed off using washing water containing detergent and the washed dishes are dried.

Such dishwasher includes a garbage filter disposed in the wash tub. Accordingly, washing water after completing the washing flows through the garbage filter, to allow garbage contained in the washing water to be filtered off.

However, the garbage filter of the related art dishwasher has no any configuration to discharge garbage, and accordingly such garbage remains collected on the filter. Thus, the garbage is kept remaining on the filter until a user detaches the garbage filter from the wash tub to wash it up.

Such garbage left on the filter is unsanitary and may also make a user unpleasant. Furthermore, the garbage filter should be continuously washed, thereby causing the user's inconvenience.

SUMMARY OF THE INVENTION

Therefore, an object of the present invention is to provide a garbage collecting apparatus of a dishwasher capable of minimizing the re-injection of collected garbage onto dishes.

Another object of the present invention is to provide a garbage collecting apparatus of a dishwasher having a configuration that at least part of collected garbage can automatically be discharged.

To achieve these and other advantages and in accordance with the purpose of the present invention, as embodied and broadly described herein, there is provided a garbage collecting apparatus of a dishwasher in which washing water is pumped by a washing pump to wash garbage on targets to be washed, and then such used washing water is drained by a drain pump, the apparatus including a first garbage collecting net, and a second garbage collecting net having a mesh size relatively greater than that of the first garbage collecting net.

In one aspect of the garbage collecting apparatus of the dishwasher, the garbage collecting nets disposed in the garbage collecting apparatus are configured to have different mesh sizes, respectively, such that the garbage collecting nets can collect different sizes of garbage from each other. Thus, various sizes of garbage can be filtered by the garbage collecting apparatus.

Also, the garbage collecting apparatus of the dishwasher can be configured such that the first garbage collecting net can be connected to a washing pump connecting passage extending toward a washing pump and the second garbage collecting net can be connected to a drain pump connecting passage extending toward a drain pump. Accordingly, relatively great garbage, such as a drain of rice or the like, cannot pass through the first garbage collecting net connected to the washing pump connecting passage, thereby to flow toward the drain pump via the second garbage collecting net connected to the drain pump connecting passage. That is, relatively small garbage can only flow toward the washing pump. Therefore, the relatively great garbage can be prevented from being introduced in the washing pump, and such garbage can rather be induced toward the drain pump to thusly be automatically discharged to the exterior.

Also, in the garbage collecting apparatus of the dishwasher, the size and amount of garbage contained in washing water introduced in the washing pump connecting passage can be reduced. Accordingly, it can be minimized for such garbage to be re-injected onto dishes via the washing pump. Relatively great garbage, such as a drain of rice, can automatically be discharged out of the dishwasher, such that a decomposition, a displeasure, an inconvenience due to washing of the collecting nets and the like which may be caused when such garbage remains in the garbage collecting apparatus can be solved.

In one aspect of the garbage collecting apparatus of the dishwasher, the garbage collecting nets disposed in the garbage collecting apparatus are configured to have different mesh sizes, respectively, such that the garbage collecting nets can collect different sizes of garbage from each other. Thus, various sizes of garbage can be filtered by the garbage collecting apparatus.

Also, the garbage collecting apparatus of the dishwasher can be configured such that the first garbage collecting net can be connected to the washing pump connecting passage extending toward the washing pump and the second garbage collecting net can be connected to the drain pump connecting passage extending toward the drain pump. Accordingly, relatively great garbage, such as a drain of rice or the like, cannot pass through the first garbage collecting net connected to the washing pump connecting passage, thereby to flow toward the drain pump via the second garbage collecting net connected to the drain pump connecting passage. That is, relatively small garbage can only flow toward the washing pump. Therefore, the relatively great garbage can be prevented from being introduced in the washing pump, and such garbage can rather be induced toward the drain pump to thusly be automatically discharged to the exterior.

Also, in the garbage collecting apparatus of the dishwasher, the size and amount of garbage contained in washing water introduced in the washing pump connecting passage can be reduced. Accordingly, it can be minimized for such garbage to be re-injected onto dishes via the washing pump. Relatively great garbage, such as a drain of rice, can automatically be discharged out of the dishwasher, such that a decomposition, a displeasure, an inconvenience due to washing of the collecting meshes and the like which may be caused when such garbage remains in the garbage collecting apparatus can be solved.

In addition, the garbage collecting apparatus of the dishwasher has a garbage receiving portion formed in at least one garbage collecting net, thus to enable the reception of a collected garbage. Hence, it is effective to prevent the garbage collected by the garbage collecting apparatus from being randomly deviated due to washing water.

Furthermore, the garbage collecting apparatus of the dishwasher can be implemented such that at least one garbage collecting net is inclined, which allows the garbage collected by the garbage collecting net to be moved down on a certain portion. Hence, it is effective to prevent the garbage collected by the garbage collecting apparatus from being randomly deviated due to washing water.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of a garbage collecting apparatus in a dishwasher according to the preferred embodiments of the present invention, with reference to the accompanying drawings.

Figure 1:
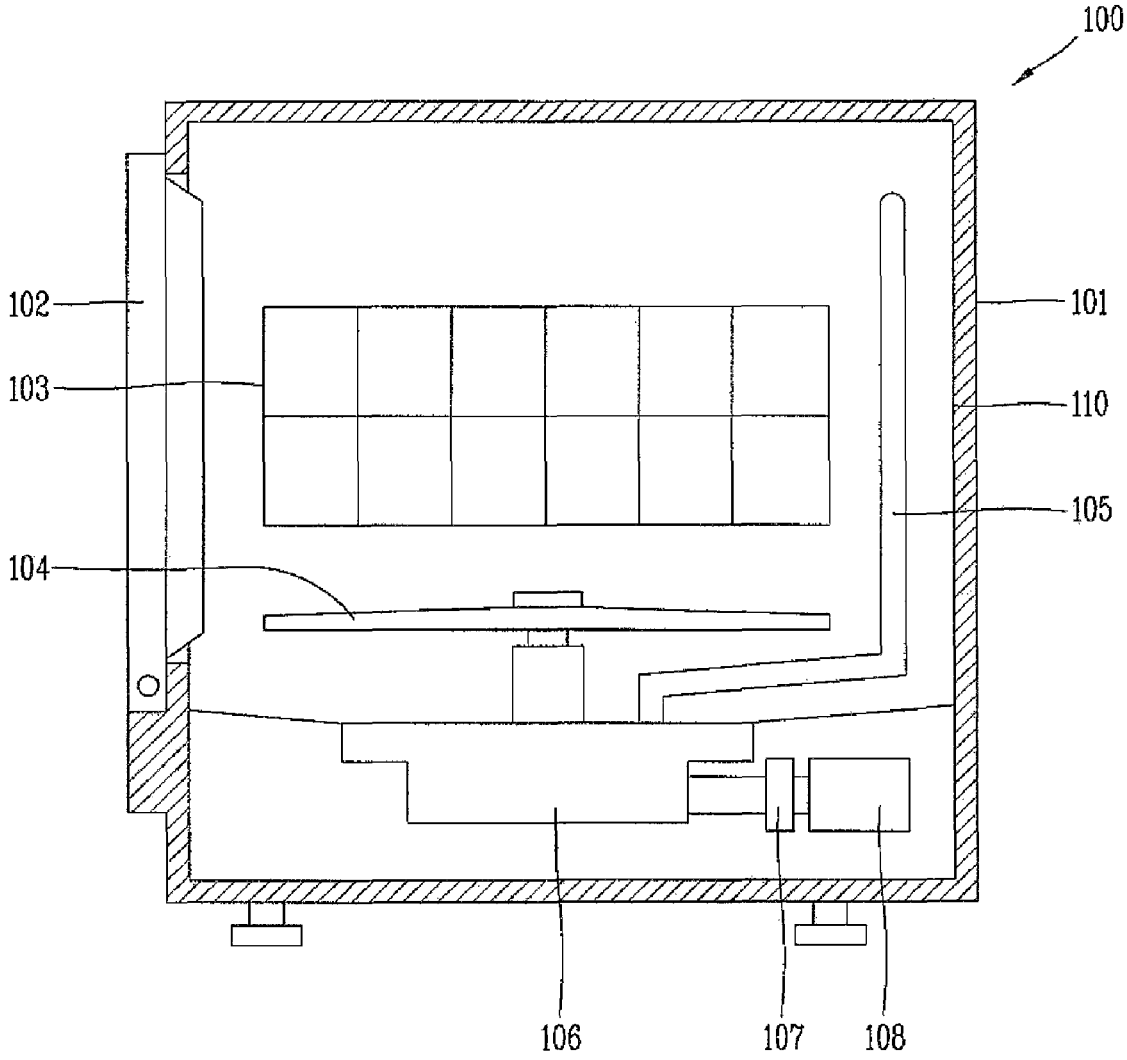
FIG. 1 is a schematic view of a dishwasher in accordance with a first exemplary embodiment of the present invention.

FIG. 1 is a schematic view of a dishwasher in accordance with a first exemplary embodiment of the present invention.

As shown in FIG. 1, a dishwasher according to a first exemplary embodiment may include a wash tub 110 installed inside a casing 101, a door 102 for opening/closing the wash tub 110, and a rack 103 installed in the wash tub 110 for containing a dishware (e.g., dishes, cups, bowls, and the like).

Also, the dishwasher 100 may further include a sump 106 installed in a lower portion of the wash tub 110 for containing washing water, an impeller 107 configured to pump the washing water contained in the sump 106, and a washing motor 108 for driving the impeller 107.

The dishwasher 100 may further include a nozzle apparatus 105 and a rotary nozzle 104 all for injecting washing water pumped from the sump 106 onto the dishes to be washed. The nozzle apparatus 105 is fixed to a rear side of the wash tub 110 to inject washing water onto the dishes. The rotary nozzle 104 is rotated by an injection pressure of washing water below the rack 103, thus to inject washing water onto the dishes. By injecting the washing water, garbage on the dishes can be removed and thusly the dishes can be washed up.

Figure 2:
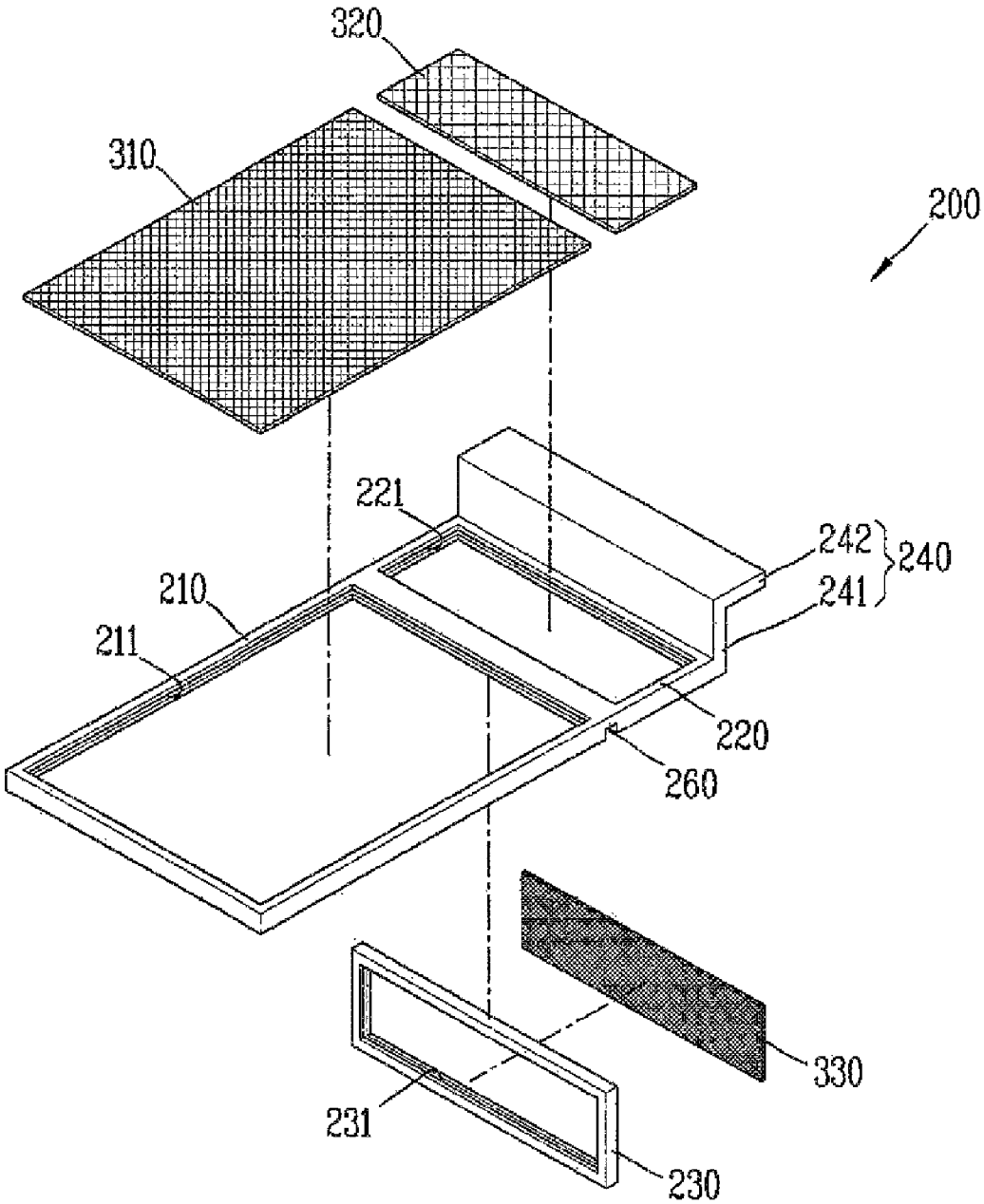
FIG. 2 is a perspective view showing a disassembled state of a garbage collecting apparatus of a dishwasher in accordance with the first exemplary embodiment of the present invention.
Figure 3:
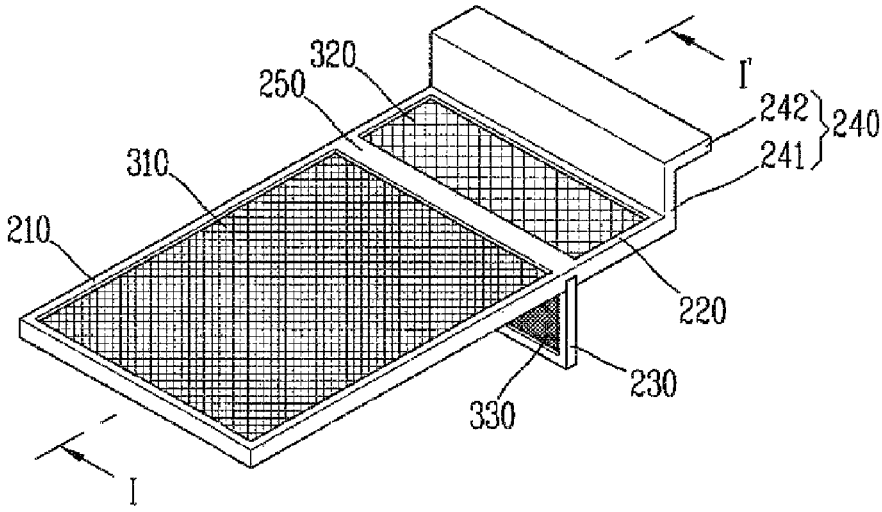
FIG. 3 is a perspective view showing a coupled state of the garbage collecting apparatus of FIG. 2.
Figure 4:
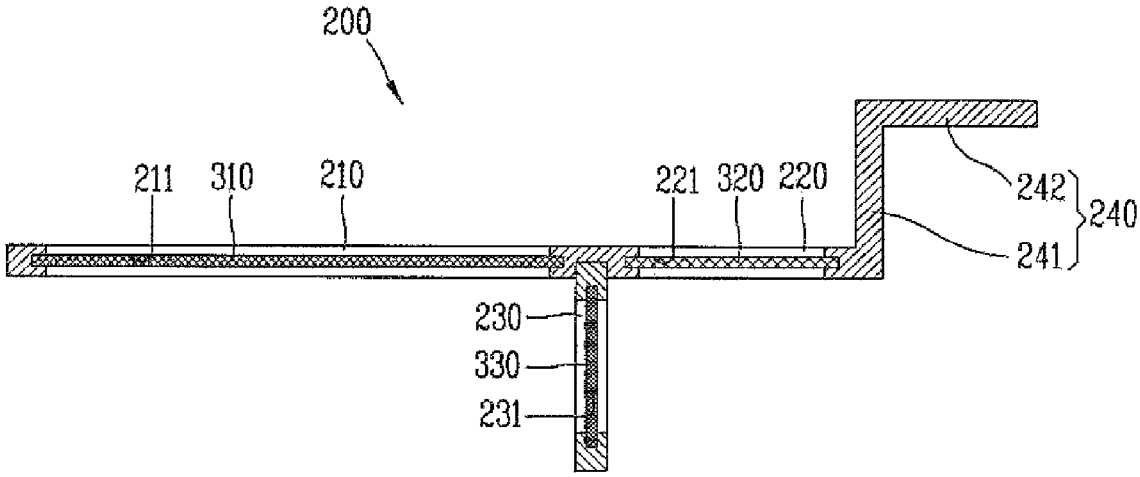
FIG. 4 is a cross-sectional view taken along the line I-I' of FIG. 3.

FIG. 2 is a perspective view showing a disassembled state of a garbage collecting apparatus of a dishwasher in accordance with the first exemplary embodiment of the present invention, FIG. 3 is a perspective view showing a coupled state of the garbage collecting apparatus of FIG. 2, and FIG. 4 is a cross-sectional view taken along the line I-I' of FIG. 3.

As shown in FIGS. 2 to 4, a garbage collecting apparatus 200 of the dishwasher according to the first exemplary embodiment of the present invention may include a first net case 210, a second net case 220, a third net case 230, an inter-net dividing portion 250, a bent portion 240, a first garbage collecting net 310, a second garbage collecting net 320, and a third garbage collecting net 330.

The first garbage collecting net 310, the second garbage collecting net 320, and the third garbage collecting net 330 are respectively coupled to the first net case 210, the second net case 220 and the third net case 230, thus to collect garbage contained in washing water.

In detail, along inner surfaces of the first net case 210, the second net case 220, the third net case 230 are respectively formed a first net coupling recess 211, a second net coupling recess 221 and a third net coupling recess 231. Accordingly, edges of the first garbage collecting net 310, the second garbage collecting net 320, and the third garbage collecting net 330 are respectively engaged with the first net coupling recess 211, the second net coupling recess 221 and the third net coupling recess 231, thereby being coupled each other.

Here, it is described that the first garbage collecting net 310, the second garbage collecting net 320, and the third garbage collecting net 330 are coupled respectively to the first net case 210, the second net case 220 and the third net case 230; however, it is merely illustrative. That is, some of the garbage collecting nets may be coupled to such cases, or the garbage collecting nets may be coupled directly to each other.

The bent portion 240 includes a longitudinal portion 241 and a horizontal portion 242. The longitudinal portion 241 is a portion extending from the second net case 220 in an approximately longitudinal direction, whereas the horizontal portion 242 is a portion extending backwardly from the longitudinal portion 241 in an approximately horizontal direction.

The formation of the bent portion 240 allows a user to detach the garbage collecting apparatus 200 from the dishwasher with grasping the bent portion 240. Therefore, it can facilitate the garbage collecting apparatus 200 to be detachable.

The inter-net dividing portion 250 is formed between the first net case 210 and the second net case 220, so as to divide the first net case 210 from the second net case 220.

An insertion groove 260 is formed in a lower end of the inter-net dividing portion 250 such that the third net case 230 is inserted therein. The insertion groove 260 is consecutively recessed along the inter-net dividing portion 250, thereby allowing the firm coupling of the third net case 230.

In the first exemplary embodiment, the first garbage collecting net 310, the second garbage collecting net 320, and the third garbage collecting net 330 are configured to have different mesh sizes from one another, such that they can filter different sizes of garbage.

In detail, the second garbage collecting net 320 has a size of mesh as great as being able to pass garbage having a size of such a grain of rice, which corresponds to relatively great size of garbage contained in washing water. The first garbage collecting apparatus 310 has a size of mesh capable of collecting garbage having relatively smaller size than garbage filtered by the second collecting mesh 320. Also, the third garbage collecting net 330 has a size of mesh as small as being able to collect garbage having relatively smaller size than garbage filtered by the first garbage collecting net 310.

As such, each garbage collecting net 310, 320 and 330 is configured to have a different size of mesh, which makes each garbage collecting net 310, 320 and 330 collect a different size of garbage, resulting in enabling the collection of garbage in various sizes by the garbage collecting apparatus 200.

Also, the first garbage collecting net 310 may be connected to a washing pump connecting passage (see 111 of FIG. 5) extending toward a washing pump, and the second garbage collecting net 320 may be connected to a drain pump connecting passage (see 112 of FIG. 5) extending toward a drain pump. Accordingly, relatively great garbage, such as a grain of rice, does not pass through the first garbage collecting net 310, but flows toward the drain pump via the second garbage collecting net 320. Relatively small garbage can only flow toward the washing pump via the first garbage collecting net 310. Therefore, the relatively great garbage can be prevented from being introduced into the washing pump. Such garbage can be induced toward the drain pump so as to be automatically discharged to the exterior.

In the meantime, the first garbage collecting net 310 and the second garbage collecting net 320 are arranged in parallel in a collecting net casing including the first net case 210, the second net case 220 and the inter-net dividing portion 250.

Figure 5:
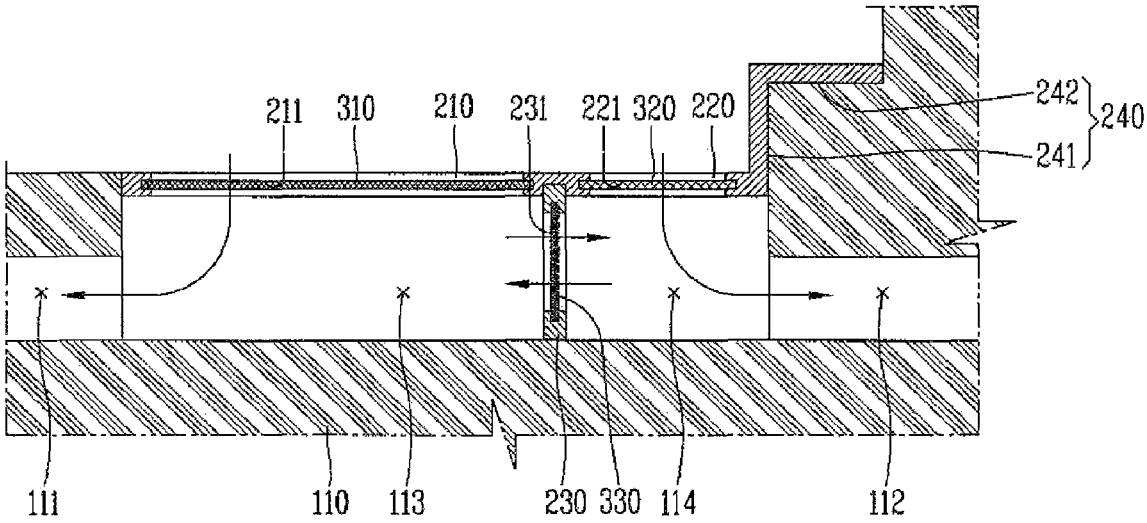
FIG. 5 is a cross-sectional view showing an operation of the garbage collecting apparatus of the dishwasher in accordance with the first exemplary embodiment of the present invention.

FIG. 5 is a cross-sectional view showing an operation of the garbage collecting apparatus of the dishwasher in accordance with the first exemplary embodiment of the present invention.

As shown in FIG. 5, the garbage collecting apparatus 200 according to the first exemplary embodiment may include a washing pump side hole 113 defined by the first garbage collecting net 310, the third garbage collecting net 330 and the wash tub 110. The washing pump side hole 113 communicates with the washing pump connecting passage 111.

A drain pump side hole 114 is defined by the second garbage collecting net 320, the third garbage collecting net 330 and the wash tub 110. The drain pump side hole 114 communicates with the drain pump connecting passage 112.

With such configuration, garbage can be filtered by passing through at least one of the first garbage collecting net 310 and the third garbage collecting net 330, and accordingly the garbage-filtered washing water can be introduced in the washing pump side hole 113. Such washing water introduced in the washing pump side hole 113 then flows into the washing pump via the washing pump connecting passage 111, so as to be re-injected onto the dishes within the wash tub 110.

Since the first garbage collecting net 310 and the third garbage collecting net 330 can collect the relatively small garbage, the size and amount of garbage contained in the washing water introduced into the washing pump connecting passage 111 can be reduced. Therefore, it can be minimized to re-inject washing water containing garbage onto the dishes via the washing pump.

On the other hand, the garbage-filtered washing water through at least one of the second garbage collecting net 320 and the third garbage collecting net 330 is introduced into the drain pump side hole 114.

As such, the second garbage collecting net 320 is configured to have a size of mesh as great as being able to pass garbage with a size of such a drain of rice. Accordingly, such relatively great garbage with the size of the grain of rice or the like is introduced in the drain pump side hole 114. The introduced washing water containing the garbage with the size of the drain of rice is introduced into the drain pump via the drain pump connecting passage 112, thereby being discharged outside.

Thus, since the relatively great garbage with the size of such a drain of rice can automatically be discharged out of the dishwasher, a decomposition, a displeasure and the like which may be caused when such garbage remains in the garbage collecting apparatus 200 can be solved.

Garbage greater than relatively great garbage such as the drain of rice can be filtered by the second garbage collecting net 320, and accordingly a disorder of the drain pump or the like due to the introduction of such great garbage can be prevented.

In the state of the third garbage collecting net 330 being installed in the third net case 230, one side of the third garbage collecting net 330 comes in contact with at least one of the first net case 210 having the first garbage collecting net 310 installed therein and the second net case 220 having the second garbage collecting net 320 installed therein. Preferably, the one side of the third garbage collecting net 330 contacts with the net dividing portion 250. Another side thereof contacts with at least one of the washing pump connecting passage 111 and the drain pump connecting passage 112. Preferably, the another side of the third garbage collecting net 330 comes in contact with the bottom of the wash tub 110.

With such configuration, the third garbage collecting net 330 can partition the washing pump side hole 113 from the drain pump side hole 114, and collect garbage such that a garbage smaller than a certain size can pass therethrough. Hence, the garbage smaller than the certain size can be discharged through the drain pump connecting passage 112 without being introduced into the washing pump connecting passage 111.

Figure 6:
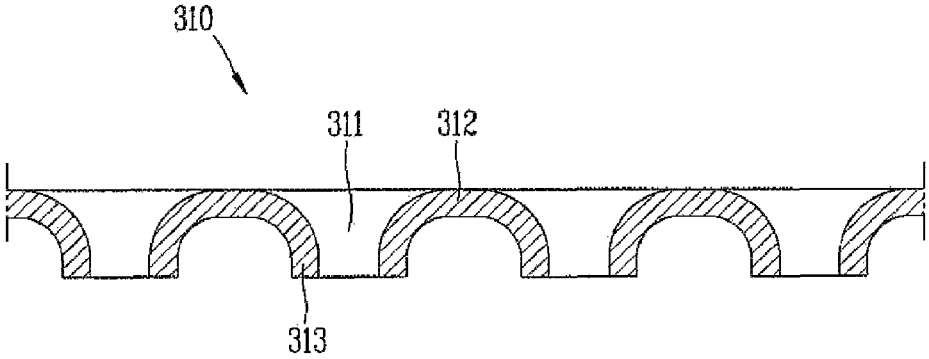
FIG. 6 is a cross-sectional view showing a part of a garbage collecting net of the garbage collecting apparatus of the dishwasher in accordance with the first exemplary embodiment of the present invention.

FIG. 6 is a cross-sectional view showing a part of a garbage collecting net of the garbage collecting apparatus of the dishwasher in accordance with the first exemplary embodiment of the present invention.

As shown in FIG. 6, the first garbage collecting net 310 of the garbage collecting apparatus 200 in accordance with the first exemplary embodiment may include garbage passing holes 311 and backflow preventing portions 313.

Each garbage passing hole 311 is a certain size of hole formed at a body 312 of the first garbage collecting net 310. The size of the garbage passing hole 311 depends on the size of garbage to be collected.

The backflow preventing portion 313 extends down to a lower end of the garbage passing hole 311, thus to prevent the garbage passing through the garbage passing hole 311 from flowing backwardly via the garbage passing hole 311. The backflow preventing portion 313 may be configured to protrude downwardly from the body 312 by a certain height. The backflow preventing portion 313 may be formed at a periphery of the garbage passing hole 311.

The rest of portions after punching the garbage passing holes 311 can function as the backflow preventing portion 313.

Hereinafter, another exemplary embodiments will be described with reference to the drawings.

For the brief explanation, the same configuration as that having already described in the first exemplary embodiment will be understood by referring to the previous description, and thusly it will not be repeated.

Figure 7:
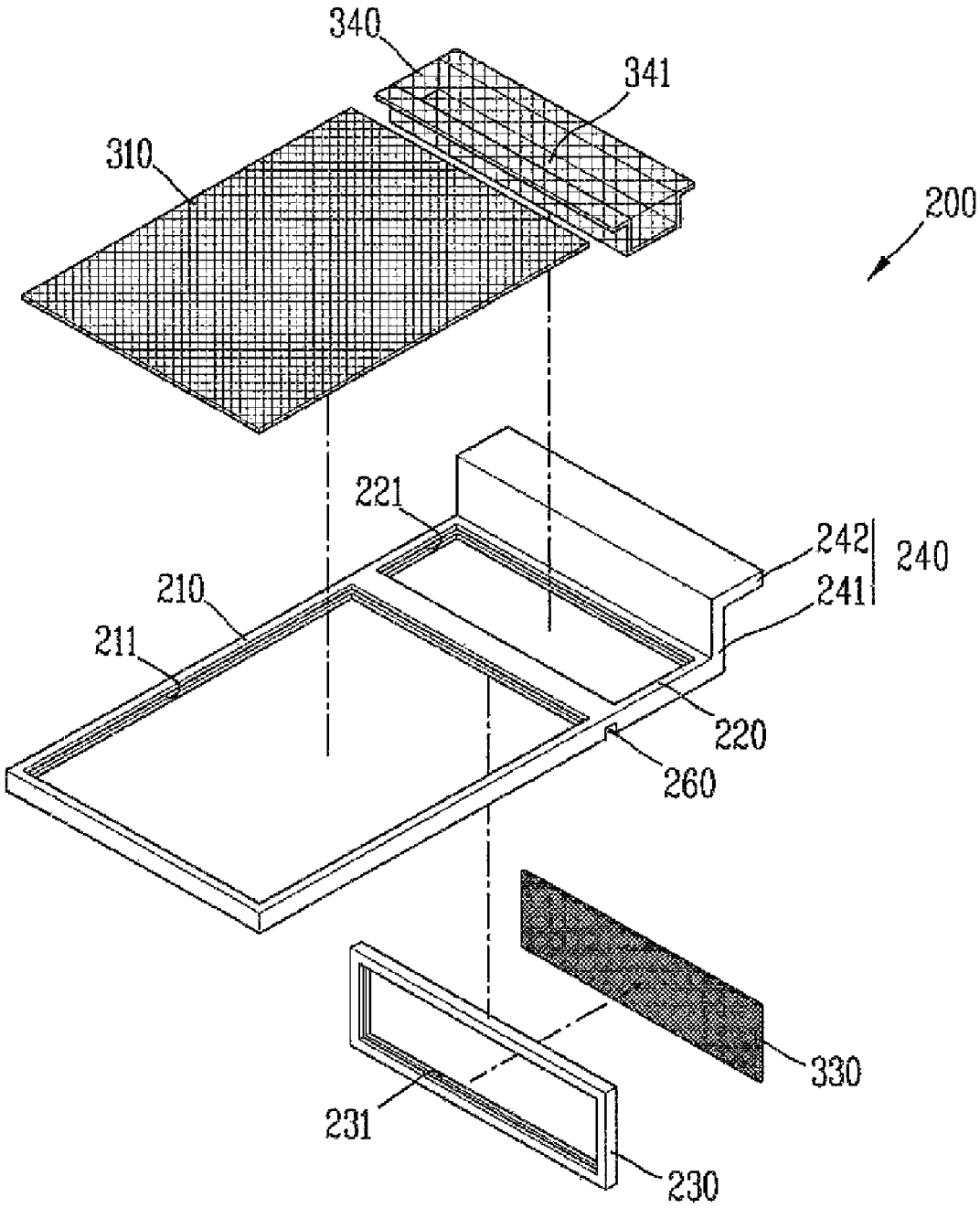
FIG. 7 is a perspective view showing a disassembled state of a garbage collecting apparatus of a dishwasher in accordance with a second exemplary embodiment of the present invention.
Figure 8:
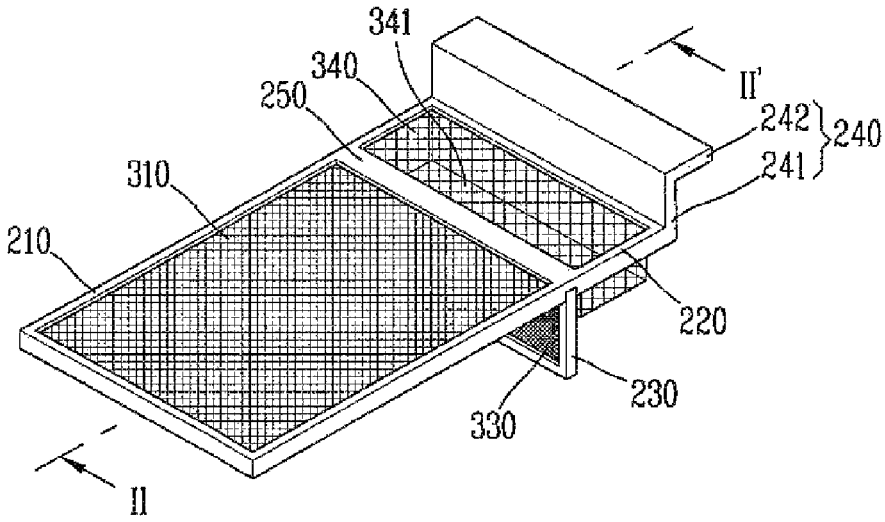
FIG. 8 is a perspective view showing a coupled state of the garbage collecting apparatus of FIG. 7.
Figure 9:
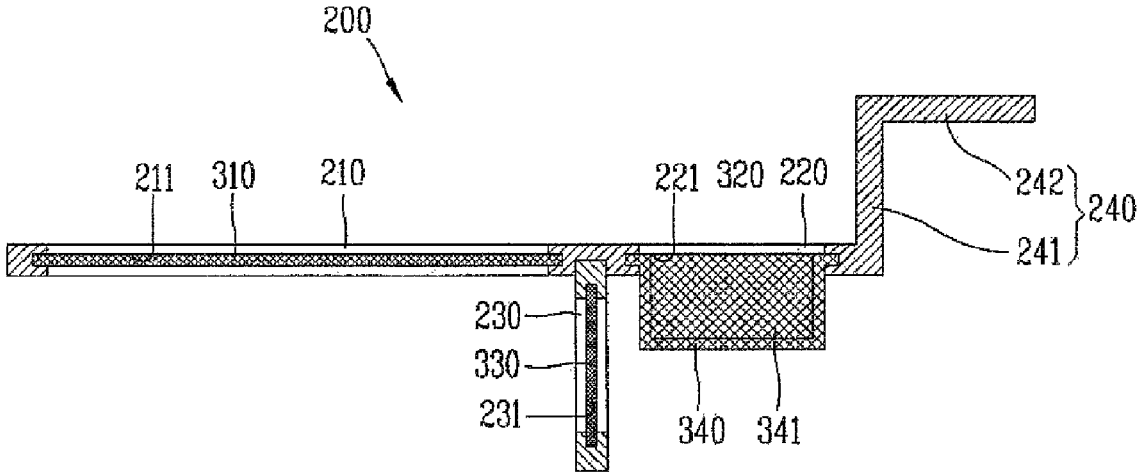
FIG. 9 is a cross-sectional view taken along the line II-II' of FIG. 8.

FIG. 7 is a perspective view showing a disassembled state of a garbage collecting apparatus of a dishwasher in accordance with a second exemplary embodiment of the present invention, FIG. 8 is a perspective view showing a coupled state of the garbage collecting apparatus of FIG. 7, and FIG. 9 is a cross-sectional view taken along the line II-II' of FIG. 8.

As shown in FIGS. 7 to 9, the garbage collecting apparatus 200 in accordance with the second exemplary embodiment may include the garbage collecting net 310, a second garbage collecting net 340 and the third garbage collecting net 330.

In this exemplary embodiment, the second garbage collecting net 340 may be formed as a basket having a garbage receiving portion 341 therein. The garbage receiving portion 341 is configured to receive the garbage collected by the second garbage collecting net 340.

As the garbage receiving portion 341 is formed, the garbage collected by the second garbage collecting net 340 can be prevented from being dispersed inside the dishwasher due to washing water.

Such garbage receiving portion 341 may substantially be formed to be parallel with the net dividing portion 250 defining a parting line between the first garbage collecting net 310 and the second garbage collecting net 340. Accordingly, the garbage receiving portion 341 can be disposed long in a lengthwise direction of the second garbage collecting net 340, thereby increasing an amount of garbage received.

Figure 10:
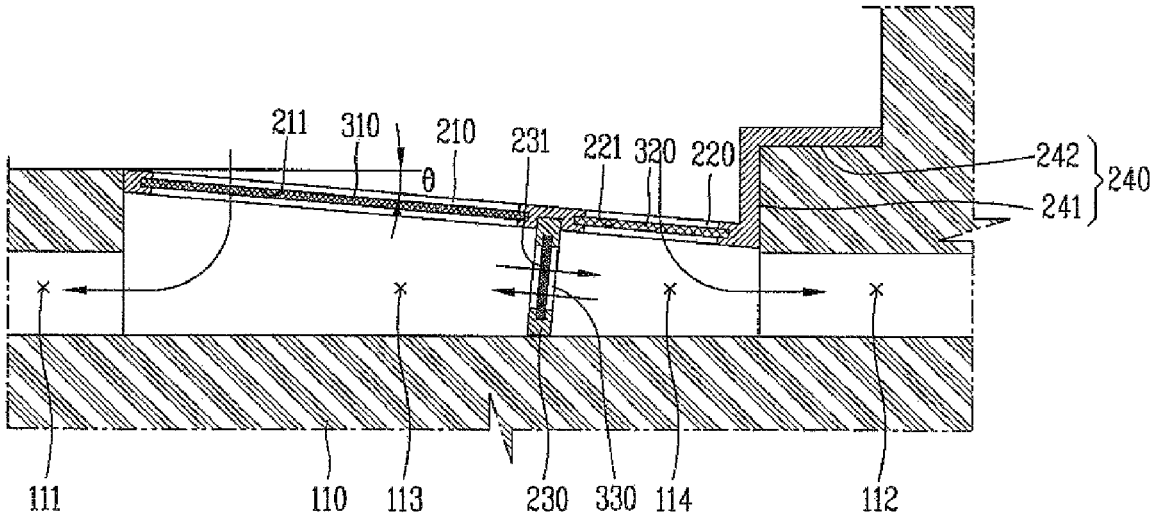
FIG. 10 is a cross-sectional view showing a garbage collecting apparatus of a dishwasher in accordance with a third exemplary embodiment of the present invention.

FIG. 10 is a cross-sectional view showing a garbage collecting apparatus of a dishwasher in accordance with a third exemplary embodiment of the present invention.

As shown in FIG. 10, the garbage collecting apparatus 200 according to the third exemplary embodiment may include the first garbage collecting net 310, the second garbage collecting net 320 and the third garbage collecting net 330.

In this third exemplary embodiment, the first garbage collecting net 310 is inclined by a certain angle.

In detail, the first garbage collecting net 310 may be inclined such that its low inclined surface is formed at the side of the second garbage collecting net 320.

With such configuration, the garbage collected by the first garbage collecting net 310 is moved (rolled) down along the inclined first garbage collecting net 310. Such garbage can be introduced in the drain pump connecting passage 112 by passing through the second garbage collecting net 320 or be collected by the second garbage collecting net 320. Hence, it is more effective to prevent the garbage collected by the garbage collecting apparatus 200 from being randomly deviated.

Here, it has been described that the first garbage collecting net 310 is inclined by the certain angle; however, it is merely illustrative. That is, another garbage collecting net or the entire of the garbage collecting apparatus 200 may be configured to be inclined.

In one aspect of the present invention, the garbage collecting apparatus of the dishwasher can be provided with the garbage collecting nets having the different mesh sizes, thus to be able to collect different sizes of garbage, respectively. Hence, various sizes of garbage can be filtered by the garbage collecting apparatus.

Also, the garbage collecting apparatus of the dishwasher can be configured such that the first garbage collecting net can be connected to the washing pump connecting passage extending toward the washing pump and the second garbage collecting net can be connected to the drain pump connecting passage extending toward the drain pump. Accordingly, relatively great garbage, such as a drain of rice or the like, cannot pass through the first garbage collecting net connected to the washing pump connecting passage, thereby to flow toward the drain pump via the second garbage collecting net connected to the drain pump connecting passage. That is, relatively small garbage can only flow toward the washing pump. Therefore, the relatively great garbage can be prevented from being introduced in the washing pump, and such garbage can rather be induced toward the drain pump to thusly be automatically discharged to the exterior.

Also, in the garbage collecting apparatus of the dishwasher, the size and amount of garbage contained in washing water introduced in the washing pump connecting passage can be reduced. Accordingly, it can be minimized for such garbage to be re-injected onto dishes via the washing pump. Relatively great garbage, such as a drain of rice, can automatically be discharged out of the dishwasher, such that a decomposition, a displeasure, an inconvenience due to washing of the collecting nets and the like which may be caused when such garbage remains in the garbage collecting apparatus can be solved.

In addition, the garbage collecting apparatus of the dishwasher has a garbage receiving portion formed in at least one garbage collecting net, thus to enable the reception of a collected garbage. Hence, it is effective to prevent the garbage collected by the garbage collecting apparatus from being randomly deviated due to washing water.

Furthermore, the garbage collecting apparatus of the dishwasher can be implemented such that at least one garbage collecting net is inclined, which allows the garbage collected by the garbage collecting net to be moved down on a certain portion. Hence, it is effective to prevent the garbage collected by the garbage collecting apparatus from being randomly deviated due to washing water.

The present invention has been explained with reference to the embodiments which are merely exemplary. It will be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

What is claimed is:

1. A garbage collecting apparatus of a dishwasher, the apparatus comprising:

a first net case;

a first garbage collecting net coupled to the first net case;

a second net case;

a second garbage collecting net coupled to the second net case and having a mesh size relatively greater than that of the first garbage collecting net;

a third net case;

a third garbage collecting net coupled to the third net case and positioned between a washing pump connecting passage and a drain pump connecting passage;

an inter-net dividing portion formed between the first net case and the second net case, so as to divide the first net case from the second net case;

an insertion groove formed in a lower end of the inter-net dividing portion such that the third net case is inserted therein, thereby allowing the coupling of the third net case; and a backflow preventing portion for preventing non-collected garbage from flowing backwardly disposed in at least one of the first garbage collecting net and the second garbage collecting net, wherein the backflow preventing portion is formed at a periphery of garbage passing holes formed in at least one of the first garbage collecting net and the second garbage collecting net and extends downwardly to a lower end of the garbage passing holes, and wherein the backflow preventing portion is formed by portions remaining after punching the garbage passing holes in the at least one of the first garbage collecting net and the second garbage collecting net.

2. The apparatus of claim 1, wherein the first garbage collecting net is connected to the washing pump connecting passage extending toward a washing pump and the second garbage collecting net is connected to the drain pump connecting passage extending toward a drain pump.

3. The apparatus of claim 1, wherein the third garbage collecting net has a mesh size relatively smaller than that of the first garbage collecting net.

4. The apparatus of claim 1, wherein the first and second garbage collecting nets are disposed to cross upper sides of the washing pump connecting passage and the drain pump connecting passage, and one end portion of the third garbage collecting net is disposed to contact with a bottom surface of the dishwasher.

5. The apparatus of claim 1, wherein the first garbage collecting net is inclined toward the second garbage collecting net.

6. The apparatus of claim 1, wherein the second garbage collecting net is provided with a garbage receiving portion for receiving garbage therein.

7. The apparatus of claim 6, wherein the garbage receiving portion is substantially parallel with a boundary line between the first garbage collecting net and the second garbage collecting net.

8. The apparatus of claim 1, wherein the first and second net cases around each of the first and second garbage collecting nets provide structure and support.

9. The apparatus of claim 8, wherein the first garbage collecting net and the second garbage collecting net are disposed parallel with each other at the first and second net cases.

10. The apparatus of claim 8, wherein the second net case includes a grip portion.

11. The apparatus of claim 10, wherein the grip portion includes:

a longitudinal portion longitudinally extending from one side of the second net case;

a horizontal portion horizontally extending from the longitudinal portion with respect to the surface of the second net case.

* * * * *